United States Patent [19]

Roffelsen

[11] Patent Number: 4,718,922

[45] Date of Patent: Jan. 12, 1988

[54] METHOD OF AND APPARATUS FOR THE DEAERATION OF LIQUID FLOWING IN A CLOSED CIRCULATION SYSTEM

[75] Inventor: Franciscus Roffelsen, AE Helmond, Netherlands

[73] Assignee: Spiro Research B.V.

[21] Appl. No.: 811,703

[22] Filed: Dec. 20, 1985

[51] Int. Cl.[4] ..... B81D 19/00

[52] U.S. Cl. ..... 55/55; 55/189; 237/66

[58] Field of Search ..... 237/66; 55/55, 165, 55/21, 38, 40, 160, 168, 189; 210/188

[56] References Cited

U.S. PATENT DOCUMENTS 4,602,923 7/1986 Bernstein ..... 55/55

*Primary Examiner*—Henry Bennet

*Attorney, Agent, or Firm*—Toren, McGeady & Associates

[57] ABSTRACT

The liquid flowing through a heat circulation system including a boiler can be maintained in an air absorbing condition even at the highest elevation in the circulation system. The air absorbing condition is attained by alternately subjecting the liquid in the boiler to the high pressure of the circulating system and at least to atmospheric pressure and effecting deaeration while the liquid is at atmospheric pressure. During deaeration the liquid is blocked from flowing from the boiler into the circulation system. Following deaeration, the liquid is brought up to the high pressure of the system before it is directed back into the system.

24 Claims, 7 Drawing Figures

METHOD OF AND APPARATUS FOR THE DEAERATION OF LIQUID FLOWING IN A CLOSED CIRCULATION SYSTEM

BACKGROUND OF THE INVENTION

The present invention is directed to a method of and apparatus for the deaeration of liquid in a closed circulation system, particularly for a heating system with a water boiler.

Water has the natural property of absorbing air from gas in the water and the presence of air in the water is particularly disadvantageous in a heating system. In heating systems in high rise buildings with the boiler located in the basement, frequently there are large accumulations of air in the heating members located on the higher floors and, as a consequence, the heating members or radiators remain cold. The problem is that the flow of water through the heating members is interrupted by the air.

Due to the high pressure present in the boiler, the relatively low level heating of the water is insufficient to release dissolved gases which could be separated out in a microbubble deaerator as disclosed in German Offenlegungsshrift No. 2 200 904. As a result, the water is in an unsaturated condition during the cooling process which permits air to separate out of the water in the heating member located at the higher elevations of the system. As the water flows upwardly, microbubbles gradually form in the water with a progressive reduction in pressure and the bubbles have sufficient time and capability to rise, since they flow slowly through the heating members. Accordingly, the microbubbles end up as air accumulations in the heating members which block the flow of water. Therefore, it is known in practice to repeatedly remove in a manual operation the air present in the system through vent valves, however, such a removal operation is both time consuming and costly.

SUMMARY OF THE INVENTION

Therefore, it is the primary object of the present invention to remove the air or gas supplied at an overpressure to a heating system particularly where a portion of the system is located a considerable distance above the boiler so that with simple mechanical means as well as with acceleration of the water, it can be placed in an air absorbing condition even at the highest elevation of the heating system whereby the presence of free air or gas in the system is no longer possible. In the following discussion while only air may be mentioned the reference to deaeration includes the separation of gases circulating in the system.

In accordance with the present invention, the liquid in the boiler is alternately subjected to high pressure and at least to atmospheric pressure and while at atmospheric pressure it is deaerated and during this period none of the liquid flows out of the boiler into the circulation system. After the liquid has been deaerated it is brought back up to the high pressure of the system and then is supplied back into the system. Based on Henry's law, the reduction of gas concentration in the liquid is possible by equilibrium restoration with the gas phase at an appropriately low pressure. The invention takes advantage of the fact that a water volume at a certain temperature is not subjected to an increase in volume, regardless of the amount of air dissolved in the water. The intermittent mode of operation affords the first phase where a deaeration or degassing of the water or liquid takes place. Accordingly, during the air or gas removal phase, the liquid cannot flow out of the boiler into the circulation system so that during this phase air released from the liquid is directed to the atmosphere. In the deaeration phase the system pressure is at one bar absolute and may even drop for a short time to a pressure below atmospheric, because of the considerable difference in pressure microbubbles are very rapidly developed and rise in the boiler for release into the atmosphere.

In the second phase following deaeration, the degassed liquid is introduced into the heating cycle at a high pressure of up to eight bar absolute. The step of raising the pressure of the boiler liquid to the high pressure of the circulation system, prior to introducing it into the circulation system, is based on the knowledge that, at the end of the deaeration phase, a certain amount of the microbubbles cling to the boiler wall and cannot be removed. These volumes of gas, during the deaeration procedure, have a pressure of one bar absolute and would be combined together when the pressure of the system is raised, whereby the water or liquid volume flowing under pressure from the system into the boiler would be greater than the liquid or water volume returned into the system in the course of mass or batch exchange under normal pressure from the boiler. This means that at the commencement of each deaeration phase a greater amount of water would be contained in the boiler. To prevent such a development, the boiler liquid is first brought up to the increased pressure of the system. Accordingly, the residual microbubbles dissolve or assume the volume corresponding to the system pressure. The liquid is converted into a highly absorbing condition before it is introduced back into the circulation cycle. Accordingly, the amount of water flowing out corresponds during heat transfer to the amount of water flowing into the boiler from the circulation system.

With each dearation phase, the overall percentage of air in the liquid is somewhat reduced, until the average air content of the circulating water has reached a degree of saturation when no or only slight amounts of microbubbles are formed in the boiler. This indicates that the existing conditions of pressure and temperature are such that an equalized balanced situation has been achieved. Water of this quality flowing into the parts of the heating system located at higher elevations will reach an unsaturated condition in view of the existing pressure and lower temperature conditions. Accordingly, an absorption of the existing air bubbles is started at the positions in the system located at higher elevations. No additional expediture of energy is needed for this process and the dearation process can be performed continuously. The duration of the various phases depends on the size of the heating system, the contents of the boiler, and the selected and most effective dearation period, for instance, every ten minutes for each complete cycle.

As an example, water at an initial temperature of 80° C. and 5 bar absolute can absorb, under certain conditions, approximately 52 liters of air per $m^3$ and this value, after reducing the pressure to one bar absolute, amounts to approximately six liters of air per $m^3$. The difference of 46 liters can be removed from the liquid in the boiler using the present invention and the air can be released into the atmosphere. When there are no free air bubbles to be absorbed in the system, a water quality is generated under the previously stated condition that at 80° C. and five bar absolute, contains only six liters of air per $m^3$ of water. Such water flowing into the heating members or radiators located in the higher part of the system with the assumed pressure of two bars absolute and an assumed water temperature of 70° C. can contain approximately 20 liters of air per $m^3$ of water. Thus up to the highest point in the heating system, the water flowing in the system is very absorptive, since it can absorb an additional 14 liters of air per $m^3$ from the existing accumulations of air, namely the difference between 20 liters $m^3$ which it can contain and the six liters per $m^3$ which it contains.

In the apparatus for carrying out the inventive method, a boiler is provided with a line connected with the suction side and another line connected with the pressure side of a circular tion pump located in the circulation system and a valve movable between opened and closed position is arranged in each line. At the highest point in the boiler a regulable venting valve opens into a dearation vessel and in the direction of flow of the liquid back to the boiler a pressure generator is located on the pressure side. The circulation pump in the system is connected to the boiler by lines containing regulable valves. During deaeration these valves are closed and the venting valve is opened. During the high pressure operation or when the boiler is connected to the heating system, the venting valve is closed and the regulable valves are opened.

The pressure generator can be arranged as a piston or a diaphragm and can be located in a line connected with the line on the pressure side leading to the boiler.

In the case where a pressure generator has a larger volumetric capacity as compared to a float valve regulated deaerator connected to the boiler with an air head above the float in the deaerator housing, it is possible to eliminate an electrically operated vent valve. Moreover, it is advantageous if the deaeration is performed using a mechanical dearator as disclosed in the German Patentschrift No. 2 200 904 where the deaeration is effected automatically. The minor volumetric increase in the pressure generator is necessary to bring the air head of the deaerator, prior to the changeover, up to the system pressure. Since in the pressure generator with a piston or diaphragm arrangement, a moving part is involved subject to wear, influences or effects on the operational sequence of the heating system can be avoided in the case of malfunction with the use of a valve which can be opened and closed in the connecting line between the boiler and the pressure generator, the pressure generator could possible be replaced during operation when the valve is closed. It is preferable to use an electrically controlled valve for this purpose. The change in the charge or batch, meaning the replacement of the contents of the boiler is improved if the line on the suction side is connected to the lowest point on the boiler and the line on the pressure side is connected to the highest point on the boiler. These lines can be arranged tangentially to a pumping mechanism with buckets or vanes located in the boiler so that the tangentially arranged pressure side connection develops a centrifugal movement in the pumping mechanism during the changeover in the supply of water in the boiler and this action assists in the deaeration. The pumping mechanism can also be equipped with a drive shaft extending out of the boiler so it can be connected to a drive motor.

To perform the intermittent deaeration reliably without the use of expensive and sensitive electrically controlled valves as well as a pressure generator subject to considerable wear, it is possible to provide two displacement pistons with different displacement volumes coupled together with the cylindrical spaces in which the pistons are located being connected to the lines of the circulation system. The sudden pressure drop can be immediately obtained by simply lowering the displacement pistons of different size so that at the time when the pistons are displaced they interrupt the connection to the lines forming the circulation system in the manner of an edge control and thus cut off the boiler from the high pressure in the heating circulation system.

Advantageously, the displacement pistons have not only different diameters but also recesses in their piston surfaces facing toward the interior of the boiler and can be moved upwardly and downwardly in the cylindrical housings or spaces at the bottom and top of the boiler with the lines of the circulating system opening into the cylinder housing. When the boiler is connected to the heating circulation system, a closed cycle is formed in which the liquid flows into the bottom of the boiler and exits at the top. During the scavenging phase the boiler liquid completely fills the concentric recess in both displacement pistons.

Preferably in this arrangement a rod which can be moved intermittently upwardly and downwardly and extends from the lower cylinder housing is used to couple the displacement pistons together. For this purpose, the shaft of the pumping mechanism extending downwardly out of the boiler can be used. The programmed or continuously operating upward and downward movement can, for instance, be achieved by a cam coacting with the lower free end of the rod or by a crank drive from a small motor with low energy consumption acting on the end of the rod. If the pistons are lowered beyond the connections to the lines of the circulating system, the water level in the boiler is lowered and below the cover a relatively large free water surface is established, that is, between the cover and the water an air space is formed and this takes place because a part of the boiler contents flows into the cylindrical space of the lower displacement piston which is larger than the cylinder space of the upper displacement piston with a corresponding lowering of the water level in the boiler. It can be assumed during the downward movement of the displacement pistons and the lowering of the water level that at least for a short period an underpressure is generated by the increase in the space containing the boiler liquid which aids in improving the deaeration procedure.

It is advisable that the wall openings in the upper ends of the displacement pistons are connected with the circulation system lines by annular lines. The water enters through the radial wall openings of the displacement pistons into the boiler through the annular lines arranged radially outwardly in the cylindrically shaped housings with the annular lines acting as distributors, or flows at the upper end of the boiler through the wall openings of the displacement pistons on the side of the cover and through the annular lines or channels back into the circulation system.

The lines or openings in the displacement piston can be arranged so that in the lower end position of the displacement piston the flow into the circulation system lines are blocked. The wall openings of the displacement pistons on the side of the cover which is smaller in diameter coincide in this position with an annular channel of the cylindrically shaped housing which includes at least one air passage or bore. The lower end positions of the displacement pistons define the deaeration phase of operation with an air space being formed below the upper displacement piston by lowering the water level. The air space depends upon the difference in the piston diameters as well as the recesses affording different large spaces available for the boiler liquid. The diameter ratio can be chosen so that in case of a downward movement of the piston through a travel of 10 cm an additional space of approximately one liter of liquid is available. The microbubbles released during the pressure drop in the dearation phase reach the atomsphere through the air space and the annular channel with the air bores connected thereto so that the microbubbles flow into the atmosphere.

Advantageously, a vent can be positioned at the upper cylindrically shaped housing. The microbubble vent as known from German Patentschrift No. 22 00 905 can, for instance, be used as a vent, since it prevents the outside air from entering into the boiler through the air bores in the annular channel.

With an upwardly and downwardly movable rod, preferably in the form of a tubular rod, with the rod having an end segment forming a check valve extending into an air space of the deaerator and also having wall openings in the region of the recess of the lower displacement piston, the tubular rod-check valve coacts with a check valve connecting the inside of the boiler and the line in the circulation system discharging into the lower cylindrically shaped housing with the check valve opening to the system line whereby changes in water volume in the vessel due to temperature fluctuations can be equalized advantageously without any damage to the apparatus. When the water flows into the known float regulated deaerator, the float rises and causes the relief valve to close and, at the same time, the check valve is open due to the pressure. The liquid flows, until normal pressure is reached, through the tubular rod out of the deaerator into the boiler and also through the valve on the bottom of the boiler back into the circulation system.

Initially, the openings to the deaerator can be attached so that the deaerator fills with water during the pressure buildup. In such an arrangement there is the advantage that the relief valve is automatically closed if the water level rises due to the movement of the rising float and all of the temperature dependent volume effects are automatically limited by the check valves, that is, each excessive pressure rise is limited to the maximum pressure by the supply of boiler liquid through the check valve back into the circulation system. Accordingly, there is a complete protection of the entire heating circulation system against any possible damage due to excessive pressure.

By the use of a centrifugal pump circulating the liquid into the boiler with the pump located in an auxiliary line of the boiler, the deaeration process can be improved and accelerated through the combined efforts of the pressure deaeration and the accelerated release of microbubbles by the vanes of the centrifugal pump. Based on the new information substantiated by scientific research, it has been indicated that short-lived pressure shocks in the range of microseconds are generated because of the high rotational speed of the centrifugal pump, for instance, 2800 rpm. Accordingly, a sudden pressure drop occurs which in the shadow of the pump, that is, behind the vanes of the pump, causes a nearly absolute vacuum and leads to a short-lived boiling phenomena of the water. This sudden pressure drop resulting from the motor power of the pump combined with the intermittent pressure deaeration, increases the microbubble content in the liquid by a multiple, because the fine microbubbles generated during the displacement of the piston, after the interruption of the connection with the circulation system lines, are combined by the pump into relatively large microbubbles which have an increased capacity to rise.

The centrifugal pump can be located at any point on the boiler so that its vanes protrude into the boiler. It is particularly advantageous, however, if the centrifugal pump is located in a secondary line leading from the lowest point to the highest point on the boiler. The centrifugal pump working independently of the pump in the circulation system aspirates a secondary flow of the liquid from the bottom of the boiler and directs the liquid, strongly enriched with microbubbles through the previously described effect, into the air space at the top of the boiler whereby the released air and any other gases circulating in the system can flow upwardly without any interference. The liquid portion of the flow directed by the centrifugal pump being heavier as compared with the air falls downwardly from the boiler and again is recirculated.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
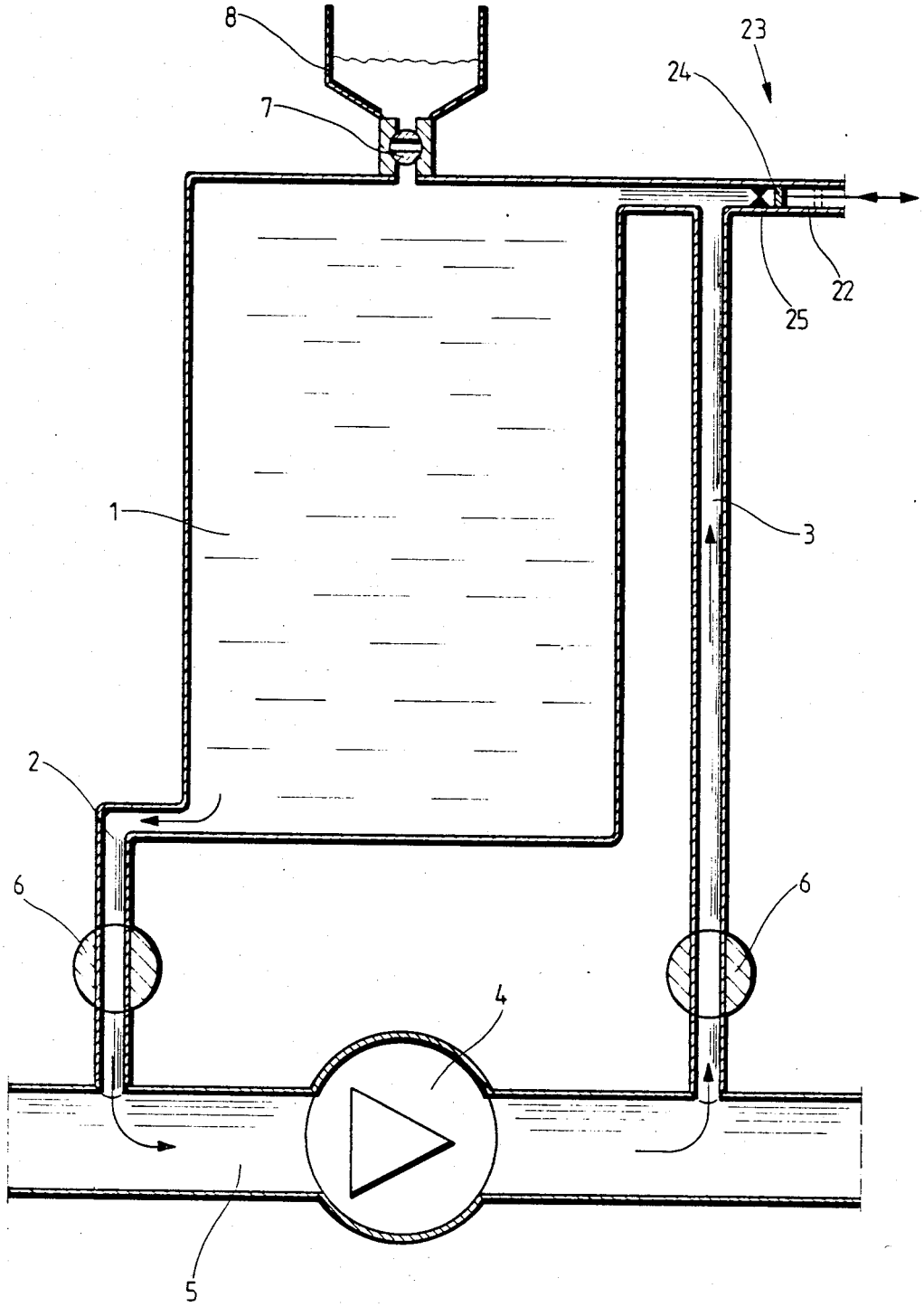
FIG. 1 is a schematic diagram of a first embodiment of a boiler in a circulating heating system in which different pressure can be applied.
Figure 3:
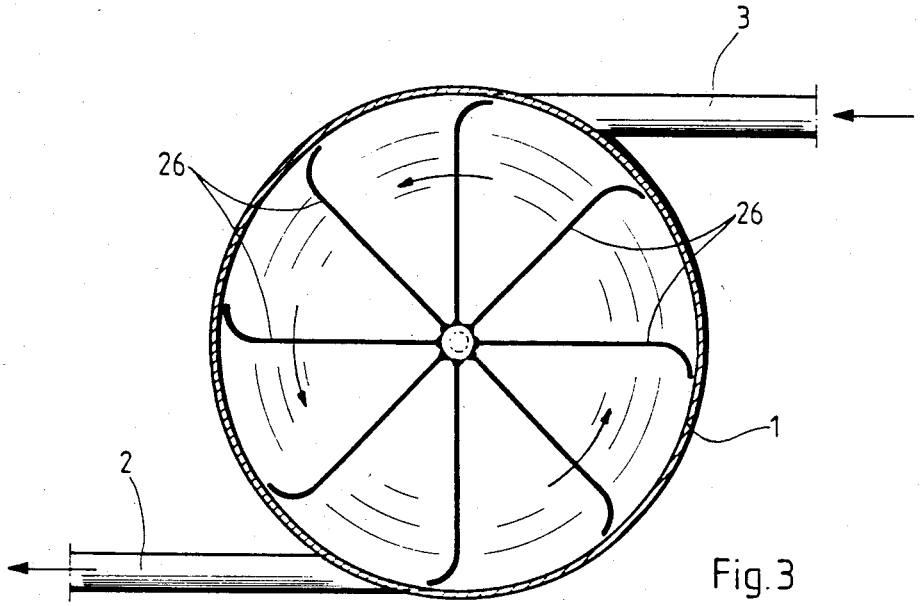
FIG. 3 is a transverse sectional view through the boiler shown in FIG. 2 taken along the line II—II.

In FIG. 1 a boiler 1 is shown with a suction side line 2 and a pressure side line 3 each connected tangentially of the boiler, note FIG. 3, with the line 2 located at the lowest point on the boiler and the line 3 connected to the highest point on the boiler. The boiler 1 is connected with a circulating heating system, not shown in detail, through a system line 5 containing a circulation pump 4. An electrically operated valve 6 is located in each of the suction side line 2 and the pressure side line 3 so that in the closed position of the valves no water can flow from the boiler into the circulating system. In addition, a vent valve 7 is located in the top of the boiler and when it is open microbubbles can rise out of the boiler and flow into the atmosphere passing through an open venting vessel 8 containing a supply of water so that there is a water level above the valve 7.

Figure 4:
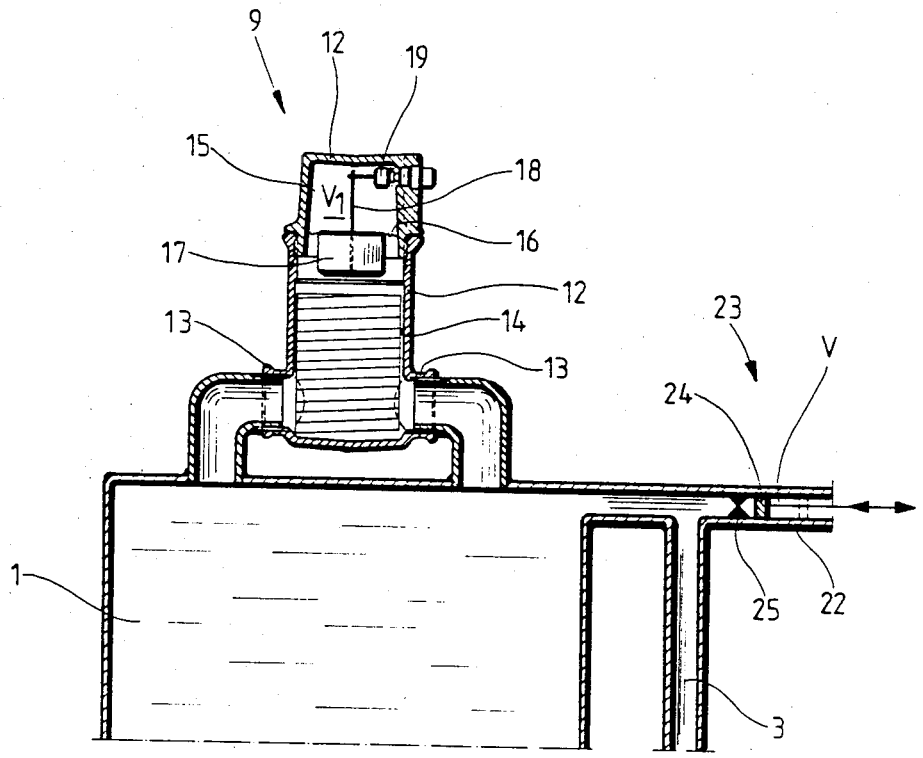
FIG. 4 is a partial vertical section illustrating a known deaerating device positioned on the boiler.

In place of an electrically operated vent valve 7, an automatically operated mechanical deaerator 9, such as displayed in FIG. 4, can be used. The deaerator 9 has an essentially cylindrically shaped housing 12 with connector portions at its lower end so that it can be connected to the boiler. The very turbulent flow of water entering the connecting part 13 encounters a wire insert 14 which brakes the motion of the water and brings it to complete rest. Air bubbles contained in the water rise and enter an air head or space 15 above the water level 16 in the deaerator 9. A float 17 holds a valve 19 in the closed position by means of an actuator rod 18. As additional air flows into the deaerator, the float drops causing the valve to open so that air is blown off until the float reaches its original position and causes the valve to reseat.

At the location of the connection of the line 3 with the boiler 1 there is a pressure generator 23 arranged in an additional line or housing 22. The pressure generator 23 has a displaceable piston 24 which can be displaced from a normal pressure position shown in dotted lines into a high pressure position shown in solid lines and in the high pressure position the boiler is exposed to maximum pressure. A shutoff valve 25 is located between the pressure generator and the boiler so that maintenance can be carried out on the pressure generator 23 without interfering with the circulating heating system. In the boiler 1 with a mechanical deaerator 9 the displacement volume V of the pressure generator 23 is slightly greater than the volume $V_1$ of the air head 15.

Figure 2:
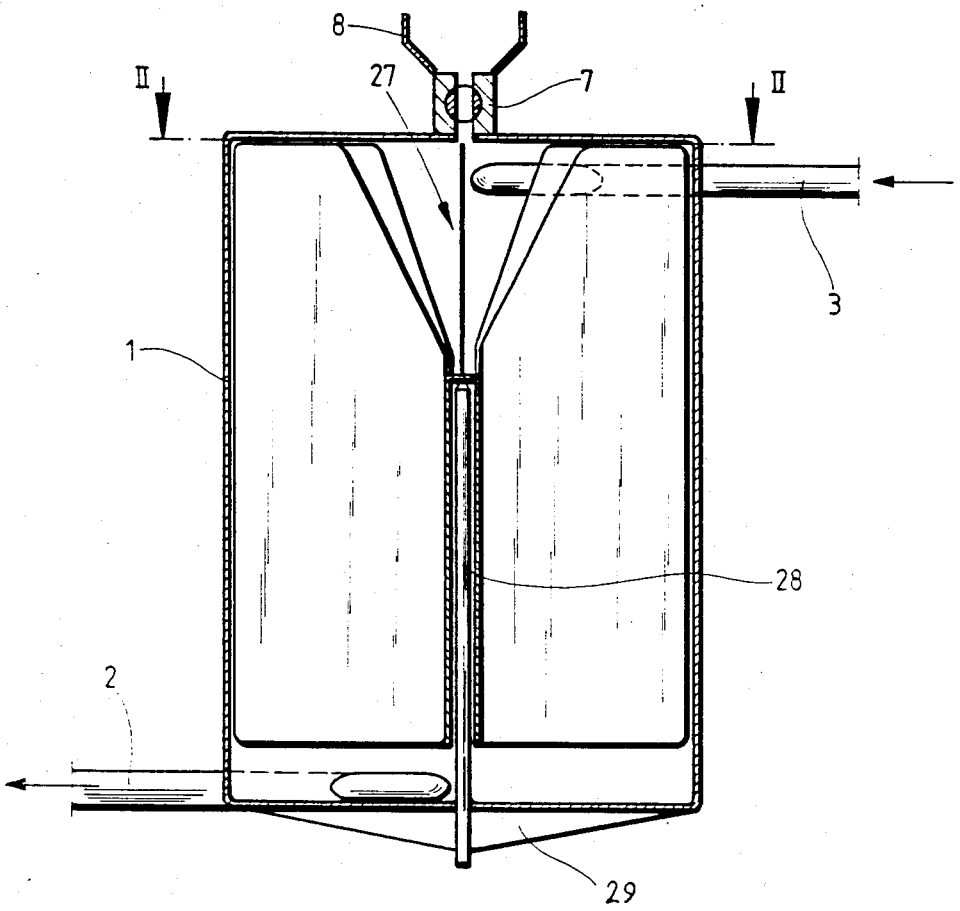
FIG. 2 is a vertical sectional view through the boiler illustrated in FIG. 1 with an additional pumping mechanism.

In FIGS. 2 and 3 a pumping device 27 is located in the boiler 1 and is made up of a number of vanes or buckets 26 arranged to be easily rotatable by a central drive shaft 28 extending downwardly through the boiler for aiding in separating the air microbubbles. It would be possible to attach a motor to the lower end of the drive shaft, note FIG. 2. Due to the rotational movement of the vanes or buckets 26, the microbubbles released during the deaeration phase reach, during rotation, the middle of the boiler 1 so that they can be rapidly directed through the valve 7 or the deaerator 9. With each deaeration phase, the air content of the water gradually diminshes, accordingly, it is advisable to lengthen correspondingly the cycle period. The operational program for the circulating heating system can be adjusted depending on the size of the system and as a result of experience, so that the high pressure phase and the deaeration phase only alternate at long time intervals in a spot check manner, when free air is no longer present in the water and the water has reached its constant maximum absorption capability. Any dirt or the like introduced in the water into the boiler during operation of the heating system, can be collected in dirt traps arranged at the bottom of the boiler and such traps can be of any known type and, as a result, have only been shown schematically in FIG. 2 as black boxes 29. For example, the dirt trap may be a bundle of wire covered tubes. The cleaning of the bundle of wire covered tubes can be effected periodically through a valve or a flap, not shown. The dirt can also be collected in a sump of the boiler 1.

The method of deaerating the water can basically be utilized with cold water, however, the intermittent mode of operation would have to be maintained over a longer time period, since the accelerating effect caused by the heating water would not be present. This also applies to older installations using open expansion vessels in which the continuous absorption of air through the open water level should be prevented, such as by the use of a layer of oil or a floating plastic plate.

Figure 5:
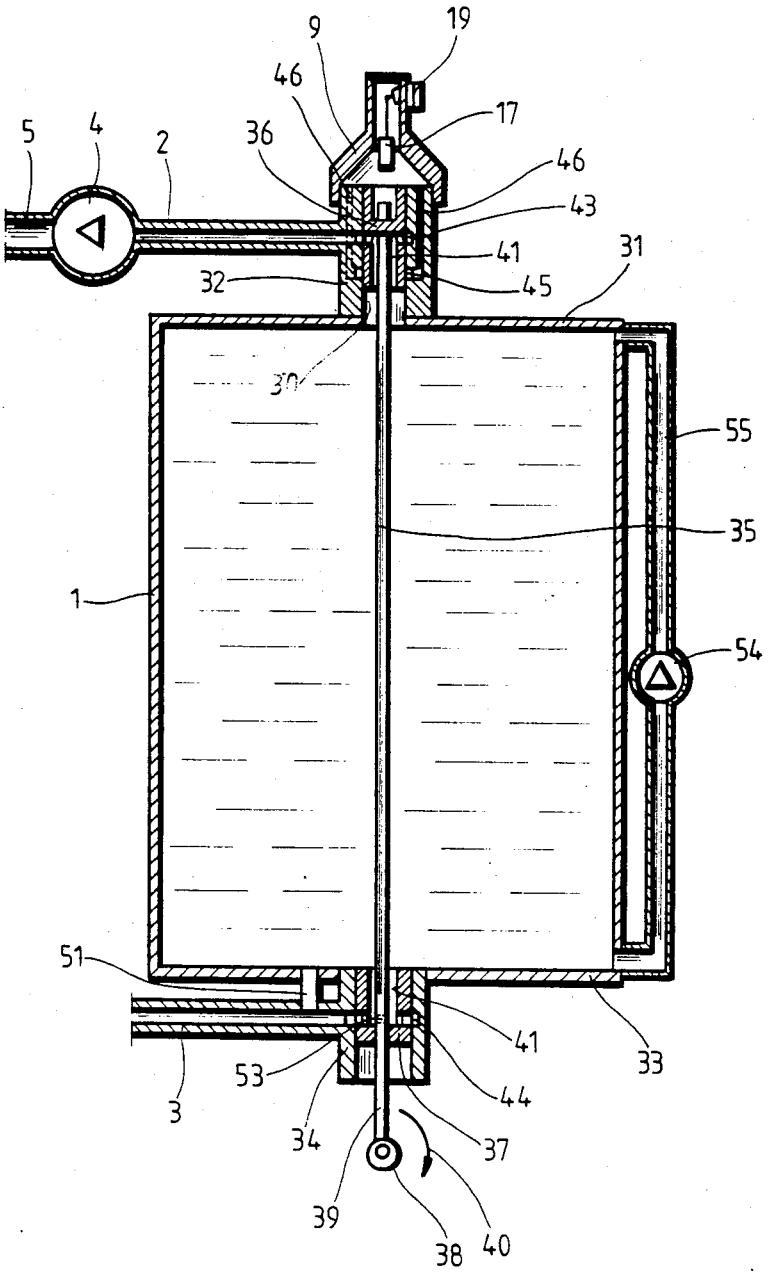
FIG. 5 is a schematic showing of a second embodiment of a boiler in a circulating heating system which operates at different pressures and shown in the phase when the boiler is connected to the circulating system.
Figure 6:
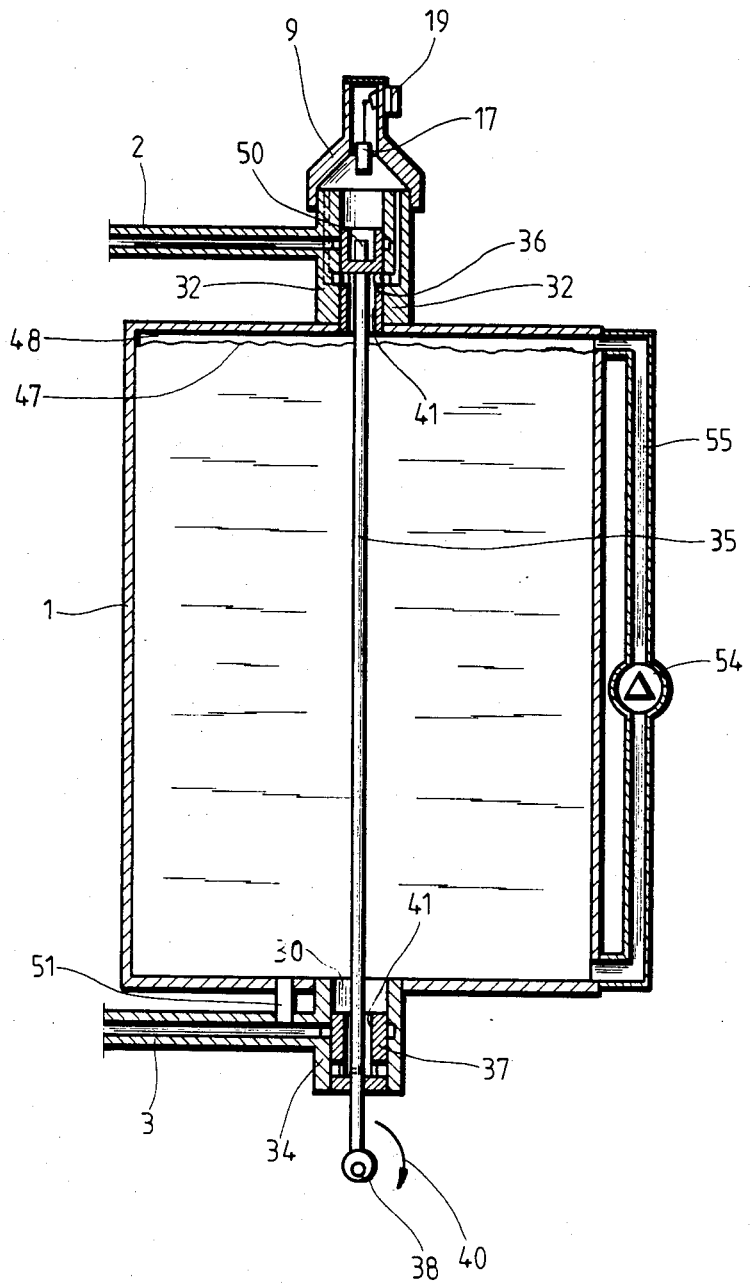
FIG. 6 is a schematic representation, in vertical section, of the boiler shown in FIG. 5, however, displaying the deaeration phase with the boiler cut off from the circulation system.

In the embodiment displayed in FIGS. 5 and 6, the lines 2, 3 each discharge into a cylindrically shaped space 30 in a cylindrically shaped housing 32 located at the top of the boiler or into a cylindrically shaped housing 34 positioned at the bottom of the boiler. Each of the housings 32, 34 have a displacement piston 36, 37 with the pistons being coupled together by a tubular rod 35 extending vertically through the boiler so that the pistons are guided to afford a sliding motion. Displacement piston 36 at the top of the boiler has a smaller diameter than the displacement piston 37 located at the bottom of the boiler. The tubular rod has its lower end 39 projecting downwardly out of the boiler and is arranged to be moved upwardly or downwardly by means of a cam disc or an eccentric 38 rotating in the direction of the arrow 40 and engaging the free end 39.

In the so-called scavenging phase displayed in FIG. 5, the boiler 1 is connected to the circulating system and the boiler liquid flows into the system in a closed cycle exiting through the line 2 at the top of the boiler and returning through the line 3 in the bottom of the boiler.

Each displacement piston 36, 37 has a cylindrically shaped recess in the form a blind bore arranged concentrically relative to the piston and being open toward the inside of the boiler. In addition the base of each recess has a radially extending wall opening 42. Wall openings 42 register in the upper position of the displacement pistons 36, 37 with annular passages 43, 44 located in the upper and lower cylihdrically shaped housings 32, 34, respectively. The annular passages 43, 44 are connected with the circulating system lines 2, 3 and thus afford a connection to the heating system.

In the upper housing 32 there is an annular passage or channel 45 and in the lower end position of the upper displacement piston 36 the annular passage is located opposite the wall openings 42. The annular passage 45 open to air bores 46 which extend upwardly through the housing 32 parallel to the displacement piston 37 and open to the space within the deaerator 9. The deaerator 9, FIG. 4, is controlled by the float 17 and is positioned on the upper end of the upper cylindrically shaped housing 32. The air bubbles contained in and released from the water can, after rising into the annular passage 45, flow into the air bores 46 and can be released through the valve 19 in the deaerator 9.

In the deaeration phase, the displacement pistons 36, 37 are located in the lower end positions as depicted in FIG. 6. Due to the larger lower displacement piston 37 as compared to the upper displacement piston 36, and because of the additional space available for the boiler liquid, when the pistons are in the lower position, the water level in the boiler is lowered and an air space 48, note FIG. 6, is formed between the boiler cover 31 and the water level 47. With the pistons in the lower position, the water cannot flow out of the boiler into the circulating system and during this deaeration phase the air is released and separated out of the water flowing into the atmosphere. The microbubbles liberated in the liquid by the changeover from the high pressure of the heating system to the normal atmospheric pressure or below atmospheric pressure experience a free passage upwardly into the deaerator. The blowoff or relief valve 19, note FIG. 4, extends outwardly through the deaerator and includes a check valve 49 in the form of a ring which prevents the flow of air from the atmosphere into the deaerator and thus into the boiler 1. In the event of possible temperature fluctuations, water reaches the deaerator 9 through the annular passage 45 and the air bores 46 with small quantities of the water causing the float to rise and to close the valve 19, due to the dimensions of the deaerator 9.

Figure 7:
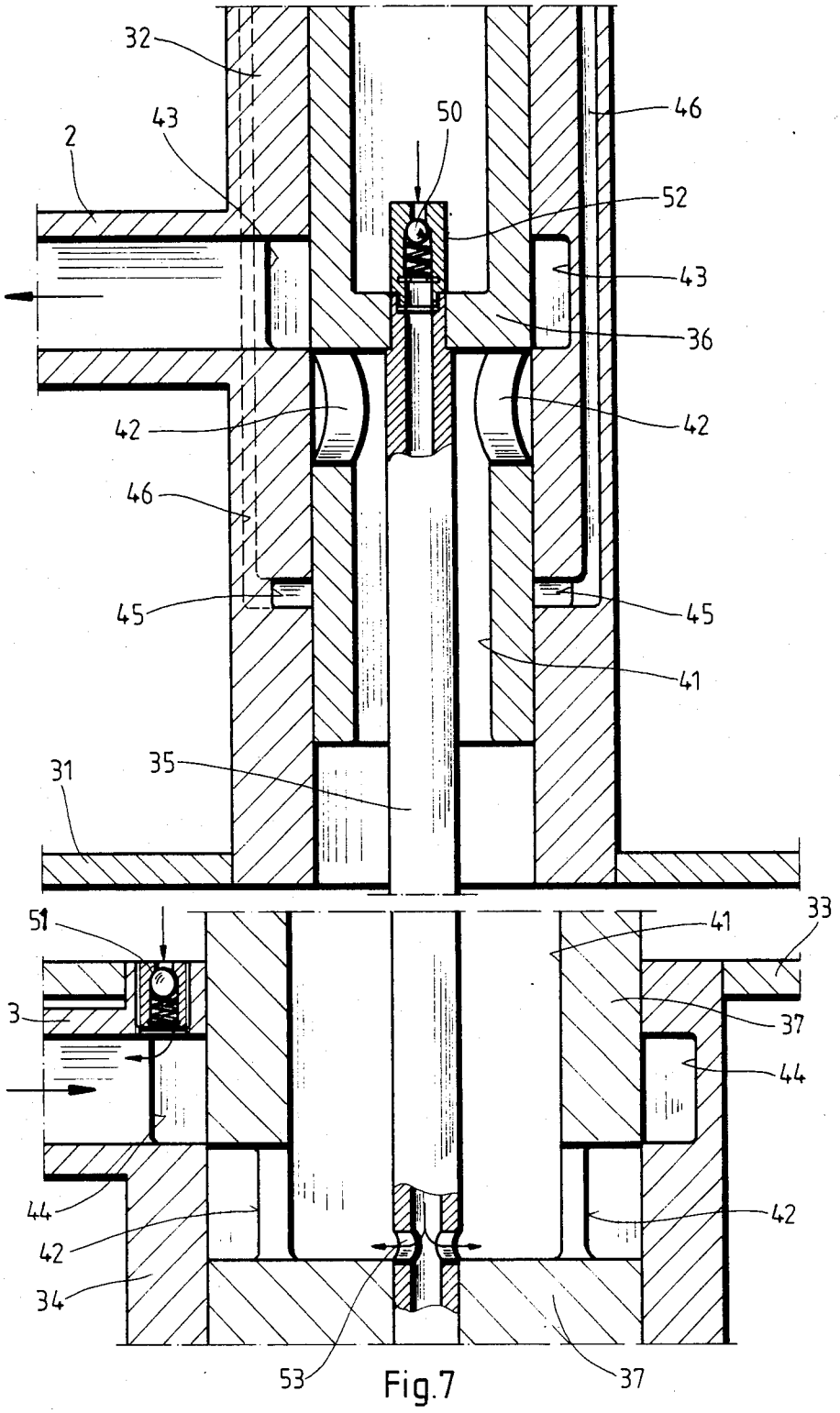
FIG. 7 is an enlarged partial vertical section of the upper and lower portions of the boiler shown in FIG. 6 including cylindrically shaped housings for displacement piston.

Overpressure within the boiler 1 is limited by two check valves 50, 51 to a value corresponding to the design value of the circulating system. The first check valve 50 is located at the head or upper end 52 of the tubular rod 35 and the second check valve 51 is located in the bottom 33 of the boiler 1. To allow water flowing through the air bores 46 into the deaerator to flow off and so that pressure can be regulated, the tubular rod is connected with a vent through the check valve 50 and, in addition, the tubular rod 35 in the region of the annular passage 44 in the lower cylindrically shaped housing 34 has openings 53, note FIG. 7. Thus when the check valve 50 opens in the event of a pressure rise above the design pressure of the system, the liquid flows through the check valve into the tubular rod 35 and flows through the wall openings 53 and the concentric recess 41 of the lower displacement piston 35 into the boiler. At the same time, check valve 51 at the bottom of the boiler opening into the lower line 3 opens if the pressure rise is above the design pressure of the system, whereby the excess liquid is fed back into the system until pressure equalization is achieved.

The limitation of the system pressure to a predetermined value by means of the check valves 50, 51 also takes place if the annular passage 45 and the air bore 46 in the upper cylindrically shaped housing 33 are arranged so that the deaerator 9 is filled with water during the pressure buildup. In such an eventuality, the rising float closes the relief valve 19 and pressures exceeding the system pressure causes the check valves 50, 51 to open so that the excess fluid is directed back into the circulating system.

The release of microbubbles during the deaeration process can be improved by the use of a centrifugal pump circulating the boiler liquid. As shown in FIGS. 5 and 6, the centrifugal pump 54 is provided in an auxiliary line 55 extending between and connected to the lowest point and the highest point of the boiler. Accordingly, the pump aspirates the boiler liquid from the bottom 33 and and forces it to flow to the boiler below the cover 31 as a dispersed medium, that is, it is divided into the smallest portion of water and air and flows into the air space 48, note FIG. 4. During the movement of the rotary vanes on the centrifugal pump a sudden pressure drop is developed on the shadow side of the vanes which causes the liberation of any air in the liquid. The combined action of the dispersion of the water and air and the liberation of the air can, in addition, be promoted by adding baffle plates against which the water or liquid is propelled.

The changeover from the circulating phase indicated in FIG. 5, with the boiler connected to the circulating heating system through the lines 2 and 3 with the system subjected to high pressure, from the deaeration phase set forth in FIG. 6, when the boiler is cut off from the circulating system and is subjected to normal pressure is explained in the following paragraph.

The downward movement of the tubular rod 35 caused by the action of the cam disc 38 at the end of the circulating phase causes a common continuous downward movement of the displacement pistons 36, 37. After the pistons have travelled a distance corresponding to the height of the annular recess or passageways 43, 44 and have assumed the position shown in FIG. 7, the circumferential peripheral surfaces of the piston block the annular recesses 43, 44 and also any flow into the lines 2, 3. During the initial movement of the displacement pistons 36, 37 until reaching the lower end positions shown in FIG. 6, the high pressure is built up in the boiler with a corresponding underpressure occurring, for a short period of time, in the upper cylindrically shaped housing 32 and also in the boiler 1. The water which fills the upper cylindrically shaped housing 32 including the recess 41 is rapidly displaced into the cylinder space and the recess 41 in the lower cylindrically shaped housing which is larger when compared with the upper cylindrically shaped housing 32. The downward movement of the displacement pistons 36, 37 is terminated when the wall openings 42 in the upper piston are located opposite the annular passage 45 connected to the air bores 36. After a random period of deaeration during which the pistons remain in the lower end position, the circulating phase is initiated by the upward displacement of the tubular rod 35.

While specific embodiments of the invention have been shown and described in detail to illustrate the application of the inventive principles, it will be understood that the invention may be embodied otherwise without departing from such principles.

I claim:

1. Method of deaerating a closed liquid circulation system for use in a heating system including a water boiler and a circulation system for receiving liquid from and returning liquid to said boiler, including maintaining the circulation system at a high pressure above atmospheric pressure and pressure degasing the liquid by periodically depressurizing the liquid, wherein the improvement comprises subjecting the entire contents within the boiler alternately to the high pressure of the circulation system and at least to atmospheric pressure, deaerating the liquid in the boiler while it is subjected at least to atmospheric pressure and during the deaeration operation preventing the flow of the liquid from the boiler into the circulation system, after deaeration, while preventing the flow of liquid from the boiler into the circulation system, bringing the liquid within the boiler up to the high pressure of the circulation system and when the high pressure has been attained in the boiler directing the liquid from the boiler into the circulation system.

2. Apparatus for deaerating a closed liquid circulation system comprising a boiler, a closed cycle circulation system connected to said boiler for recirculating the liquid from the boiler through the circulation system and back into the boiler at a high pressure above atmospheric pressure, said circulation system including a first line for conducting the liquid out of the boiler and a second line for conducting the liquid back into the boiler, a regulatable flow control valve in each of said first and second lines for selectively preventing flow from said circulation system into said boiler, a circulating pump having a suction side and a pressure side located in said circulation system with said first line connected to the suction side of said pump and said second line connected to the pressure side of said pump, a deaeration vessel located above said boiler, means connecting the top of the boiler to the deaeration vessel so that the entire contents of the boiler are accessible to the deaeration vessel, and a pressure generator located in said second line downstream from said flow control valve in said second line and connected to said boiler for selectively subjecting the entire contents of the boiler to one of the high pressure of the circulation system and at least atmospheric pressure.

3. Apparatus, as set forth in claim 2, wherein said means comprises a deaeration valve connecting the top of the boiler to the deaeration vessel, and said deaeration valve being positionable between an open and a closed position.

4. Apparatus, as set forth in claim 2, wherein said means comprises a deaerator connected to the top of said boiler in the path of flow from the boiler to the deaerator vessel.

5. Apparatus, as set forth in claim 2, wherein said pressure generator includes a conduit connected to said second line and to said boiler, and a piston member in said conduit for increasing the pressure in the second line leading into said boiler.

6. Apparatus, as set forth in claim 2, wherein said pressure generator includes a conduit connected to said second line and to said boiler, and a diaphragm member in said conduit for increasing the pressure in the second line leading into said boiler.

7. Apparatus, as set forth in claim 4, wherein said deaerator includes a float for regulating flow out of said deaerator vessel, an air head located above said float in said deaerator vessel, and said pressure generator has a higher volumetric capacity as compared to said deaerator vessel containing said float.

8. Apparatus, as set forth in claim 5 or 6, including a valve located within said conduit containing said pressure generator and positioned between said pressure generator and said boiler, and said valve being displaceable between an open condition and a closed condition.

9. Apparatus, as set forth in claim 2, wherein said first line is connected to the lowest part of said boiler and said second line is connected to the highest part of said boiler.

10. Apparatus, as set forth in claim 2, wherein said flow control valves in said first and second lines each comprise an electrically actuated valve.

11. Apparatus, as set forth in claim 2, wherein a dirt trap is located in the bottom of said boiler.

12. Apparatus, as set forth in claim 2 or 9, wherein a rotating pumping mechanism is arranged within said boiler rotating about a vertical axis extending between the bottom and top of said boiler, said first and second lines secured to said boiler and arranged tangentially to said pumping mechanism.

13. Apparatus, as set forth in claim 12, wherein said pumping mechanism has a vertically extending drive shaft extending out of said boiler.

14. Apparatus for deaerating a closed liquid circulation system comprising a boiler, a closed cycle circulation system connected to said boiler for recirculating the liquid from the boiler through the circulation system and back into the boiler, said circulation system including a first line for conducting the liquid out of the boiler and a second line for conducting the liquid back into the boiler, a regulatable flow control valve in at least one of said first and second lines, deaerator means connected to the upper end of said boiler, a first cylindrically shaped housing connected to the upper end of said boiler and a second cylindrically shaped housing connected to the lower end of said boiler, said first line connected to said first housing and said second line connected to said second housing, each of said first and second housings forming a cylindrically shaped space, a first displacement piston located in said cylindrically shaped space in said first housing and a second displacement piston located in said cylindrically shaped space in said second housing.

15. Apparatus, as set forth in claim 14, wherein said displacement pistons each having a different piston diameter, each of said first and second pistons having a recess in said piston with the recess facing into said boiler, means interconnecting said first and second pistons for moving said pistons within said spaces in said first and second housings, and said first line being in flow communication with said boiler through said first housing and said second line being in flow communication with said boiler through said second housing.

16. Apparatus, as set forth in claim 14 or 15, wherein each of said first and second pistons has a wall opening therethrough extending transversely of the direction of movement of said pistons and said housings each having an annular passage therein with the annular passage in said first housing connected to said first line and the annular passage in said second housing connected to said second line.

17. Apparatus, as set forth in claim 16, wherein said pistons are displaceable between a first position where said openings communicate through said annular recesses with said first and second lines and a second position where said wall openings are displaced blocking flow into said first and second lines.

18. Apparatus, as set forth in claim 17, wherein said piston in said first housing has a smaller diameter than said piston in said second housing, an annular channel in said first housing spaced from said annular passage therein, and at least one air bore connected to said annular channel and to said deaeration means so that when said wall opening in said first piston is displaced into said second cylinder said wall opening communicates with said annular channel.

19. Apparatus, as set forth in claim 14 or 15, wherein said deaerator means is connected to said first housing.

20. Apparatus, as set forth in claim 14 or 15, wherein said means connecting said first and second piston comprises a rod with said rod extending downwardly through said second housing and extending outwardly below said second housing.

21. Apparatus, as set forth in claim 20, wherein said rod, comprises a tubular rod said deaerator means comprises a deaerator with said tubular rod extending into said deaerator, a check valve located at the end of said tubular rod extending into said deaerator, and said tubular rod having openings in the range of said rod extending into said recess in said second housing, whereby flow through said check valve passes downwardly through said tubular rod into said recess in said second housing for effecting flow into said second line.

22. Apparatus, as set forth in claim 2 or 14, comprising a centrifugal pump for circulating the boiler liquid.

23. Apparatus, as set forth in claim 22, comprising an auxiliary line connected to said boiler at vertically spaced locations and and said centrifugal pump located in said auxiliary line.

24. Apparatus, as set forth in claim 23, wherein said auxiliary line is connected at one end to the lowest end of said boiler and at the other end to the highest end of said boiler.

* * * * *